United States Patent [19]

Szamborski

[11] 4,016,972

[45] Apr. 12, 1977

[54] DISPLAY CONTAINER FOR NECK CHAINS AND THE LIKE

[75] Inventor: Edmund Szamborski, Scarsdale, N.Y.

[73] Assignee: Edmund Szamborski, Scarsdale, N.Y.

[22] Filed: Oct. 20, 1975

[21] Appl. No.: 624,176

[52] U.S. Cl. ..... 206/45.34; 206/45.14; 206/566; 206/348; 206/470; 206/471

[51] Int. Cl.[2] ..... B65D 75/32; B65D 73/00

[58] Field of Search ..... 206/45.14, 461–470, 206/75, 348, 471, 45.34

[56] References Cited

UNITED STATES PATENTS

| | | | |
|---|---|---|---|
| 1,639,672 | 8/1927 | Schraysshuen | 206/348 |
| 1,691,937 | 11/1928 | Peter | 206/75 |
| 2,563,157 | 8/1951 | Castelli | 206/45.14 |
| 3,397,774 | 8/1968 | Tjaden | 206/45.34 |

FOREIGN PATENTS OR APPLICATIONS

| | | | |
|---|---|---|---|
| 247,002 | 2/1926 | United Kingdom | 206/75 |

*Primary Examiner*—William Price
*Assistant Examiner*—Douglas B. Farrow
*Attorney, Agent, or Firm*—Salter & Michaelson

[57] ABSTRACT

This invention relates to a display container especially adapted to display chain articles such as necklaces and the like and having interconnected base, platform and cover portions. The looped portion of the chain article to be displayed is received within a channel formed within the platform and defined by an internal upstanding boss and outer peripheral edges. The edges of the platform are supported by a circumferential ledge intermediate the upstanding walls of the base portion so as to space the article receiving platform above the base bottom wall and below the transparent top of the interfitting cover. That portion of the container lying below the platform and above the base bottom wall is adapted to receive the excess length of chain not displayed within the channel, and portions of the upstanding boss are adapted to contact the cover top so as to maintain the chain within the channel. The cover is hingedly connected to the base portion, and means are provided in the form of tabs outwardly extending from both cover and base portions for suspending the container on a display rack or the like. Further means are provided for maintaining the cover portion in closed position. The platform also includes a pair of spaced star-shaped cutouts having slotted lead-in portions for receiving and grasping various thicknesses of chain so that the looped portion thereof to be displayed may be held taut about the upstanding boss to further enhance the display features of the container.

15 Claims, 6 Drawing Figures

DISPLAY CONTAINER FOR NECK CHAINS AND THE LIKE

BACKGROUND AND SUMMARY OF THE INVENTION

Display containers for jewelry items including neck chains and the like are commonly utilized. The present invention is directed to a display container which combines a number of highly desirable features which enhance the display, shipment and use aspects of the present container in a manner hitherto unknown and unavailable to the trade.

Accordingly, a principal object of the present invention is to provide a container having a neck chain display platform positioned intermediate base and cover portions so that excess chain not desired to be displayed may be stored beneath such platform out of view and accordingly enable a standard size container to more suitably display neck chains of various lengths.

A further object of the present invention is the provision of a display container for neck chains and the like having means for preventing portions of the chain displayed in looped fashion within a platform channel from inadvertently shifting out of the channel and becoming entangled during shipment and handling.

A still further object of the present invention is the provision of a display container for neck chains and the like having interconnected component parts comprising a base and cover portion hingedly connected at one end and a platform portion disposed therebetween, and means for maintaining the cover closed with respect to the base.

A still further object of the present invention is the provision of a display container having means for suitably suspending same from display racks and the like by means of opposed outwardly extending base and cover tabs which additionally serve as a means by which the cover may be more easily grasped for opening so as to provide access to the chain supporting platform for removal or the like.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the invention.

DESCRIPTION OF THE INVENTION

Figure 6:
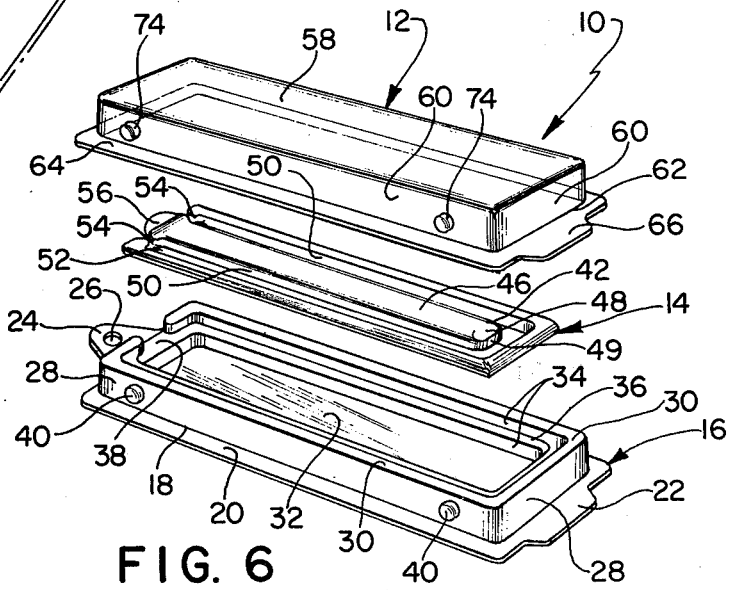
FIG. 6 is an assembly view of the three component parts of the present invention showing their respective relationship.

Referring now to the drawings and particularly FIG. 6 thereof, the component parts of the container 10 of the present invention are shown as comprising a cover 12, an article receiving platform 14 and a base portion 16. The base 16 includes a lower peripheral edge 18 having an outwardly extending peripheral flange 20 from which extension 22 extends from one end thereof and a tab or flange 24 from the opposite end thereof. Flange 24 is provided with an opening 26 to enable the suspension of the container 10 on rod or hook means or the like for display purposes, as will be more fully explained hereinafter.

Outer side walls 28 upwardly extend from the peripheral edge 18 and terminate in an upper peripheral edge 30. A depressed bottom wall 32 is located centrally within base portion 16. Upwardly extending from peripheral portions of such bottom wall 32 are inner side walls 34 which terminate at the upper peripheral edge 30 and are in turn provided intermediate their extent with an inwardly extending ledge 36. The walls 28 and 34 are provided with notched cutouts at that end thereof proximate to the outwardly extending flange 24 so as to form a ledge extension 38. The outer side walls 28 are also provided with spaced outwardly extending dimples 40, which cooperate with pockets formed in cover 12 to frictionally maintain said cover in closed position, as hereinafter to be described in more detail. The base may be and is preferably formed from suitable plastic sheet material, as by vacuum molding techniques, and the upper surfaces thereof are preferably provided with decorative flocking, which further increases the frictional contact between the base, platform and cover portions.

Figure 1:
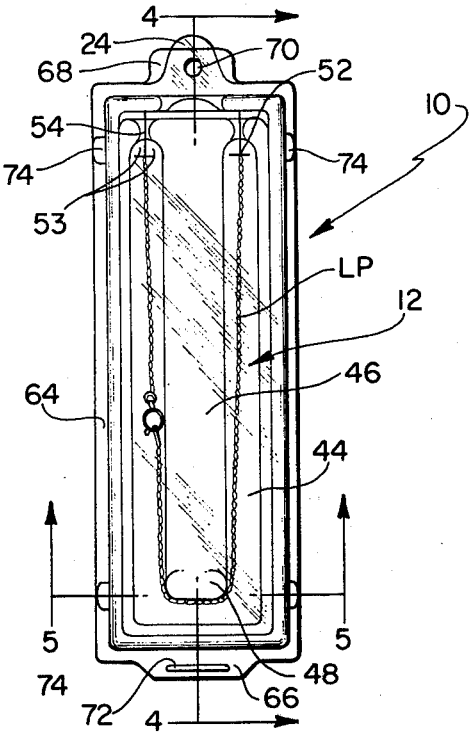
FIG. 1 is a top plan view showing the container embodying the present invention.
Figure 2:
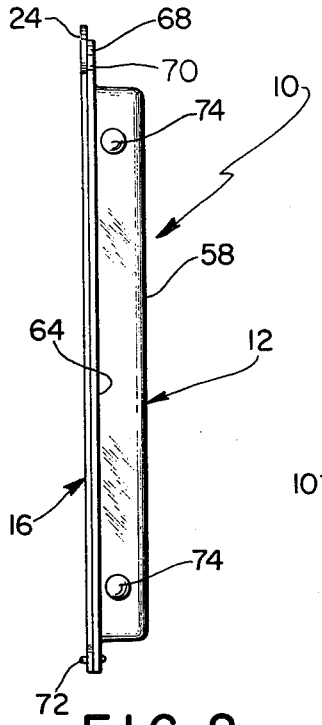
FIG. 2 is a side view thereof.
Figure 3:
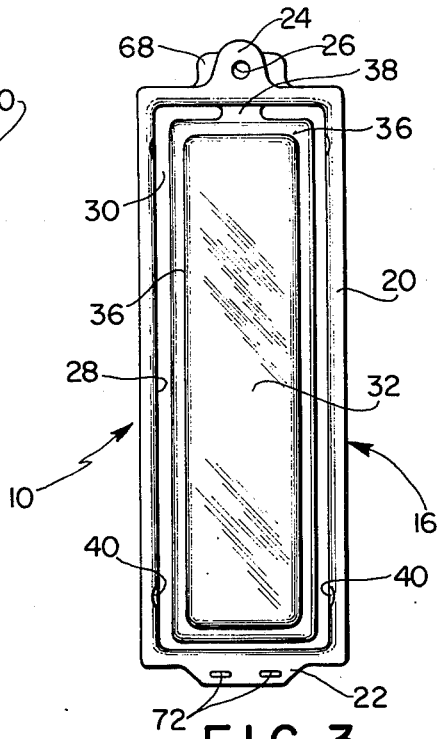
FIG. 3 is a bottom plan view thereof.
Figure 4:
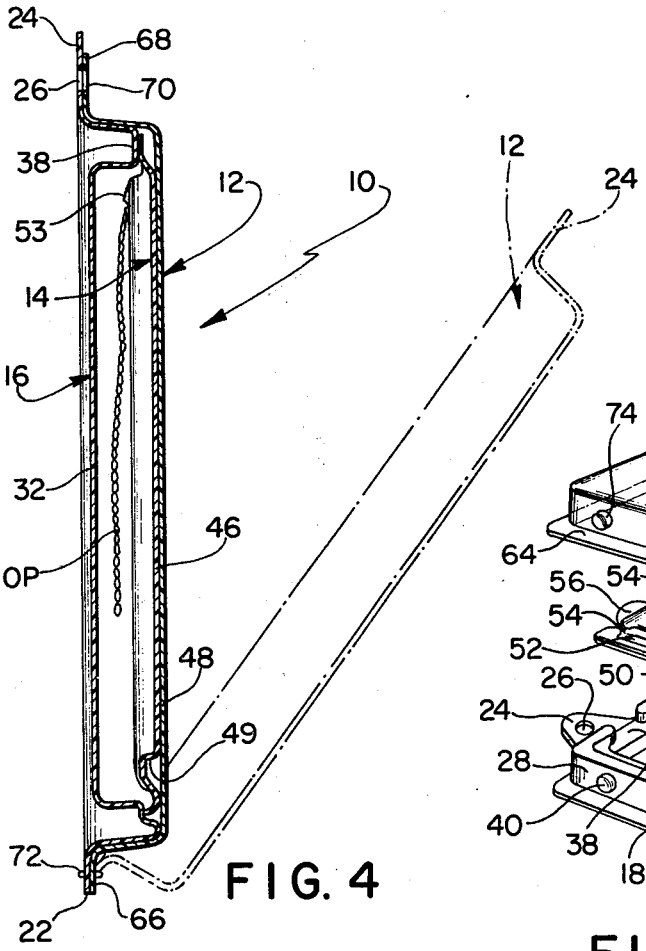
FIG. 4 is a side sectional view thereof taken along the line 4—4 of FIG. 1 and showing in phantom the cover portion of the container in an open position hingedly pivoted away from the base portion.
Figure 5:
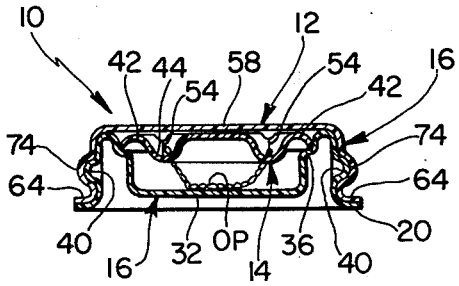
FIG. 5 is an end sectional view taken along the line 5—5 of FIG. 1.

The chain receiving platform 14 is provided with a peripheral edge 42 adapted to rest on the base ledge 36 as best depicted in FIGS. 4 and 5 of the drawing. The platform further includes a generally U-shaped article receiving channel 44 having opposed legs 50. The channel 44 is positioned inwardly of the circumferential edge 42 and outwardly of an upstanding boss 46, which in turn includes a pronounced hump 48 at the base thereof. The upward extension of the boss is gently contoured to present a smooth transition with the chain receiving channel 44 while the pronounced hump 48 is more sharply defined and exhibits generally vertical wall portions 49 to better engage the chain portion looped around it. Each leg 50 of the channel 44 is provided at its upper terminus with an opening 52 of star-shaped configuration defining a plurality of deflectable segments 53 and a slotted access opening 54 extending from said opening 52 through adjacent portions of said platform peripheral edge. In this manner then, the looped portion LP of a chain may be extended around raised hump 48 with each running chain strand thereof inserted into and through an opening 52 by means of the access slot 54 and held thereby with the desired degree of tautness. Thus, the chain loop may be drawn tightly against the raised hump 48 or made to more loosely lie within the article receiving channel 44, if desired. In any event, the star shaped configuration of the openings 52 will accommodate various size chain thicknesses and enable the flexible flap portions 53 thereof to engage between the links thereof so as to hold the chain firmly in place.

Other portions OP of the chain are free to hang in back of the platorm as best shown by FIG. 4 of the drawing, and adapted when the container 10 is in its normal display mode, as depicted in FIG. 5 of the drawing, to be supported by the bottom wall 32 of the base 16. The platform 14 is further provided with an outwardly extending tab 56 which extends into the ledge extension 38 to facilitate grasping as an aid when it is desired to remove the platform from the container as for customer examination of the chain supported thereby. The platform may be formed of suitable plastic material utilizing the same molding techniques as applied to the base portion, and similarly may incorporate a flocked upper surface to provide the chain receiving channel 44 with a softer surface for receiving the chain and one more resistant to chain slippage thereacross, as well as enhancing the aesthetic appearance thereof.

The cover 12 includes a top 58 and side walls 60 downwardly extending therefrom and terminating in a lower peripheral edge 62. Outwardly extending from the edge 62 is a flange 64 including a lower tab 66 outwardly extending therefrom at a lower end of said flange 64 and an upper outwardly extending tab 68. The tab 68 is provided with an opening 70 therethrough adapted for alignment with the opening 26 in the tab 24 so as to provide a positive means by which the container 10 may be suspended by a rod or hook (not shown) associated with a display rack or the like. In this way such a rod or hook extends through both base and cover portions and thus assures that the container cannot be opened while on display.

The bottom flange extension 66 is adapted to overlie and align with the flange extension 22 of the base 16 when the cover and base are in closed position, as best shown in FIG. 4 of the drawing. In such position the flange extensions 66 and 22 are permanently connected to each other, as by staple 72 shown, or by any other suitable attachment means, such as heat sealing, adhesive connection or formed interconnection. The cover 12 is thus free to hinge to an open position as best shown by the phantom representation thereof in FIG. 4 of the drawing. Such attachment not only provides a hinge interconnection at the lower portion thereof, and thus prevents inadvertent opening of the container at its lower end while suspended on display, as previously indicated, but further eliminates the possibility that the cover could become separated from the remainder of the container and accidently substituted for a similarly shaped cover belonging to a different container. This is especially important where, as contemplated by the present invention, the cover 12 thereof is formed of transparent plastic material and is provided with indicia identifying the contents of that particular container on the top surface thereof.

The side walls 60 of the cover 12 are further provided with outwardly extending pockets 74 which are aligned to receive respective dimples 40 of the base 16 so as to more positively connect the cover and the base portions when in closed disposition with each other. In that regard it should be apparent that the cover 12 is formed of thin flexible plastic material which is outwardly deformable so that the side walls 60 will ride over the dimples 40 as the cover is being closed upon the base, and thereafter when respective pockets 74 and dimples 40 are aligned, side walls 60 will be free to inwardly deflect so as to form an interlocking holding means assuring maintenance of the cover in a closed position, as when the container is moved about, as in transit or in shipment.

It will be noted that the respective flanges 24 and 68 are not of the same configuration, that is, portions thereof are not in contiguous relationship with each other so that such noncontiguous portions may be grasped by the fingers of the user and accordingly provide a convenient means by which the base and cover portions of the container may be separated to the open, outwardly hinged position shown in FIG. 4. From such position the user may conveniently grasp the platform tab 56 and remove such and the chain displayed therein.

As will be seen most clearly in FIGS. 4 and 5, the top surface of boss 46 engages top 58 of cover 12 when the latter is in closed or assembled position, thus providing positive means for maintaining the chain LP in channel 44, whereby any posibility of the chain accidently becoming removed from the channel during shipment or handling is effectively prevented, it being understood that snarling or entanglement of the chain would likely result, if it were possible for the chain to become removed from said channel during shipment or handling.

Accordingly, it should be apparent that a new and novel display container for neck chains and the like is presented which serves a number of interrelated purposes in a highly convenient manner and which has equal utility as a display or shipping container. The container further provides a maximum amount of security both from theft while on display and from accidental interchange of the cover and base portions from different containers.

While there is shown and described herein certain specific structure embodying the invention, it will be manifest to those skilled in the art that various modifications of the parts may be made without departing from the spirit and scope of the underlying inventive concept and that the same is not limited to the particular forms herein and described except insofar as indicated by the scope of the appended claims.

What is claimed is:

1. A display container for chains such as necklaces comprising, an assembly consisting of separate base, platform and cover portions, said base comprising a bottom wall having a peripheral bottom edge with interconnected side and end walls extending upwardly therefrom and terminating in an upper peripheral edge, the inner surfaces of said side and end walls having an inwardly extending ledge upwardly spaced from said bottom wall and terminating short of said upper peripheral edge, said platform having an interior chain receiving channel disposed therein, an upstanding boss disposed within said channel and a peripheral edge extending outwardly from said channel, said peripheral edge adapted to contact said base ledge to support said platform above and spaced from said bottom wall, said chain receiving channel having means for receiving a running length of chain, and wherein central cavity positioned beneath said platform and defined by said bottom wall, said interconnected side and end walls and said platform is formed for receipt of excess chain when a loop thereof is placed in said chain receiving channel about said upstanding boss, said cover having a top and side walls downwardly extending therefrom and terminating in a lower peripheral edge, said cover adapted for receipt of said base when said container is in a closed position.

2. The display container of claim 1, said receiving means comprising openings having means therearound frictionally grasping said running lengths of chain so as to firmly position same within said channel.

3. The display container of claim 1, said channel being of generally elongated U-shaped configuration and said receiving means being positioned adjacent the upper terminus of each leg thereof.

4. The display container of claim 2, said frictional grasping means comprising openings of star-shaped configuration having a plurality of deformable segments extending therearound.

5. The display container of claim 4, a pair of slots through said platform peripheral edge, each said slot terminating at said opening thereby providing means permitting access of said chain to said openings.

6. The display container of claim 1, said upstanding boss contacting portions of said cover top when the assembly is in a closed position to prevent the chain loop received by said channel from moving across said boss.

7. The display container of claim 3, said boss being of elongated generally U-shaped configuration and contacting portions of said cover top when the assembly is in a closed position to prevent the chain loop received in said channel from moving across said boss.

8. The display container of claim 7, said boss having a pronounced hump at the lower terminus thereof, said hump having relatively sharply defined supporting sidewalls adapted for contact with said chain loop.

9. The display container of claim 1, said cover hingedly connected to said base at one end thereof.

10. The display container of claim 9, the peripheral edge of said base having an outwardly extending flange at one end thereof, said cover having a corresponding flange outwardly extending from said lower peripheral edge, said flanges in opposed contacting relationship to each other, and means for hingedly connecting said flanges together.

11. The display container of claim 10, including means for suspending said container from rod means, said base and said cover each having a second flange outwardly extending from their respective peripheral edges opposite said hinged connection and in opposed contacting relationship to each other, said second flanges each having an opening therethrough, said openings aligned for receipt of said rod means.

12. The display container of claim 11, said second flanges having noncontiguous portions to facilitate separately grasping said base and cover portions when opening said container.

13. The display container of claim 9, said base having a notched ledge extension extending completely through said end wall opposite said hinged connection, said platform having a tab received in said ledge extension and extending outwardly of aid end wall for ease in finger grasping when sid cover is in an open position.

14. The display container of claim 1, including means for maintaining said container in closed position comprising dimples outwardly extending from said base side and end walls and corresponding pockets outwardly extending from said cover side walls, said dimples received in said pockets when container is in a closed position.

15. The display container of claim 4, said cover hingedly connected to said base at one end thereof and said base having a notched ledge extension extending completely through said end wall opposite said hinged connection, said platform having an outwardly extending peripheral edge tab disposed between said pair of slots, said tab received in said ledge extension and extending outwardly of said end wall for ease in finger grasping when said cover is in an open position.

* * * * *